US008271271B2

(12) United States Patent
Breithaupt et al.

(10) Patent No.: US 8,271,271 B2
(45) Date of Patent: Sep. 18, 2012

(54) METHOD FOR BIAS COMPENSATION FOR CEPSTRO-TEMPORAL SMOOTHING OF SPECTRAL FILTER GAINS

(75) Inventors: Colin Breithaupt, München (DE); Timo Gerkmann, Bochum (DE); Rainer Martin, Bochum (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 585 days.

(21) Appl. No.: 12/504,887

(22) Filed: Jul. 17, 2009

(65) Prior Publication Data

US 2010/0014695 A1 Jan. 21, 2010

(30) Foreign Application Priority Data

Jul. 21, 2008 (EP) ..... 08013121

(51) Int. Cl.
*G10L 11/04* (2006.01)

(52) U.S. Cl. ..... 704/206; 704/200; 704/200.1

(58) Field of Classification Search ..... 704/200–230
See application file for complete search history.

(56) References Cited

U.S. PATENT DOCUMENTS

| | | | | |
|---|---|---|---|---|
| 8,005,666 | B2 * | 8/2011 | Goto et al. | 704/207 |
| 2002/0002455 | A1 * | 1/2002 | Accardi et al. | 704/226 |
| 2007/0055508 | A1 * | 3/2007 | Zhao et al. | 704/226 |
| 2007/0118367 | A1 * | 5/2007 | Dickson et al. | 704/221 |
| 2007/0276660 | A1 * | 11/2007 | Pinto | 704/219 |
| 2008/0097754 | A1 * | 4/2008 | Goto et al. | 704/214 |

OTHER PUBLICATIONS

Madhu et al., "Temporal Smoothing of Spectral Masks in the Cepstral Domain for Speech Separation", Institute of Communication Acoustics, ICASSP 2008, pp. 45-48, 1-4244-1484-9/08/$25.00 © 2008IEEE.

Lotter et al., "Speech Enhancement by MAP Spectral Amplitude Estimation Using a Super-Gaussian Speech Model", EURASIP Journal on Applied Signal Processing, 2005:7, pp. 1110-1126, © 2005.

Ephraim et al., "Speech Enhancement Using a Minimum Mean-Square Error Short-Time Spectral Amplitude Estimator", IEEE Transactions on Acoustics, Speech and Signal Processing, Dec. 1984, vol. ASSP-32, No. 6, 0096-3518/84/1200-1109$01.00 © 1984 IEEE.

Malah et al., "Tracking Speech-Presence Uncertainty to Improve Speech Enhancement in Non-Stationary Noise Environments", AT&T Labs, Research, Florham Park, NJ, pp. 1-4.

Colin Breithaupt, Timo Gerkmann, and Rainer Martin, "Cepstral Smoothing of Spectral Filter Gains for Speech Enhancement without Musical Noise"; IEEE Signal Processing Letters, vol. 14, No. 12, Dec. 2007; pp. 1036-1039; revised Jun. 11, 2007.

Colin Breithaupt, Timo Gerkmann, and Rainer Martin; "A Novel a Priori SNR Estimation Approach Based on Selective Cepstro-Temporal Smoothing"; 2008; pp. 4897-4900; Institute of Communication Acoustics (IKA); Ruhr-Universität Bochum, 44780 Bochum, Germany.

* cited by examiner

*Primary Examiner* — Douglas Godbold

(57) ABSTRACT

A method for modification of a cepstro-temporally smoothed gain function of a gain function resulting in a bias compensated spectral gain function is provided. The cepstro-temporal smoothing increases the quality of an enhanced output signal, as it affects only spectral outliers caused by estimation errors, while the speech characteristics are well preserved. However, due to the cepstral transform, the temporal smoothing is done in the logarithmic domain rather than the linear domain, and hence results in a certain bias. Thus, the method for a general bias compensation for a cepstro-temporal smoothing of spectral filter gain functions that is only dependent on the lower limit of the spectral filter-gain function.

15 Claims, 3 Drawing Sheets

METHOD FOR BIAS COMPENSATION FOR CEPSTRO-TEMPORAL SMOOTHING OF SPECTRAL FILTER GAINS

CROSS REFERENCE TO RELATED APPLICATIONS

This application claims priority of European Patent Office Application No. 08013121.2 EP filed Jul. 21, 2008, which is incorporated by reference herein in its entirety.

FIELD OF INVENTION

The present invention relates to a method for compensating the bias for cepstro-temporal smoothing of filter gain functions. Specifically, the bias compensation is only dependent on the lower limit of the spectral filter gain function. Moreover, the present invention relates to speech enhancement algorithms and hearing aids.

BACKGROUND OF INVENTION

In the present document reference will be made to the following documents:

[1] C. Breithaupt, T. Gerkmann, and R. Martin, "Cepstral smoothing of spectral filter gains for speech enhancement without musical noise," IEEE Signal Processing Letters, vol. 14, no. 12, pp. 1036-1039, December 2007.

[2] C. Breithaupt, T. Gerkmann, and R. Martin, "A novel a priori SNR estimation approach based on selective cepstro-temporal smoothing," IEEE ICASSP, pp. 4897-4900, April 2008.

Many successful speech enhancement algorithms work in the short-time discrete Fourier transform (DFT) domain. A drawback of DFT based speech enhancement algorithms is that they yield unnatural sounding structured residual noise, often referred to as musical noise. Musical noise occurs, e.g. if in a noise-only signal frame single Fourier coefficients are not attenuated due to estimation errors, while all other coefficients are attenuated. The residual isolated spectral peaks in the processed spectrum correspond to sinusoids in the time domain and are perceived as tonal artifacts of one frame duration. Especially when speech enhancement algorithms operate in non-stationary noise environments unnatural sounding residual noise remains a challenge.

Recently, a selective temporal smoothing of parameters of speech enhancement algorithms in the cepstral domain has been proposed [1, 2] that reduces residual spectral peaks without affecting the speech signal. In [1] the algorithms based on cepstro-temporal smoothing (CTS) are compared to state-of-the-art speech enhancement algorithms in terms of listening experiments. In [1] it is shown that CTS yields an output signal of higher quality especially in babble noise, and that the number of spectral outliers in the processed noise is less than with state-of-the-art algorithms. In the literature it is shown that CTS yields an output signal of increased quality when applied as a post processor in a speaker separation task. However, due to the non-linear log-transform inherent in the cepstral transform, a temporal smoothing yields a certain bias as compared to a smoothing in the linear domain. This bias results in an output signal with reduced power. While the reduced signal power has only a minor influence on the results of listening experiments, instrumental measures are often sensitive to a change in signal power. Thus, instrumental measures may indicate a reduced signal quality if CTS is applied, while listening experiments indicate a clear increase in quality.

In [2] CTS is applied to a maximum likelihood estimate of the speech power to replace the well-known decision-directed a-priori signal-to-noise ratio (SNR) estimator. It is shown that a CTS of the speech power may yield consistent improvements in terms of segmental SNR, noise reduction and speech distortion if a bias correction is applied.

SUMMARY OF INVENTION

It is an object of the present invention to provide a method avoiding instrumental measures indicating a reduced signal quality if CTS is applied while listening experiments indicate a clear increase in quality.

According to the present invention the above object is solved by a method for modification of a cepstro-temporally smoothed gain function ($\overline{G}_k(l)$) of a gain function (G) resulting in a bias compensated spectral gain function ($\tilde{G}_k(l)$) by multiplying said cepstro-temporally smoothed gain function ($\overline{G}_k(l)$) with the exponent of a bias correction value ($\kappa_G$), $$\tilde{G}_k(l)=\overline{G}_k(l)\exp(\kappa_G),$$

whereas said bias correction value ($\kappa_G$) is calculated as the difference of the natural logarithm of the expected value (mathematical expectation E { }) of said gain function (G) and the expected value (E { }) of the natural logarithm of said gain function (G), $$\kappa_G=\log(E\{G\})-E\{\log(G)\}.$$

According to a further preferred embodiment said gain function may have a probability distribution (p(G)) according to FIG. 2 and whereas the bias correction value ($\kappa_G$) can be dependent on a smallest value ($G_{min}$) of said gain function (G) and may be calculated as:

$$\kappa_G(G_{min}) = \log\left(\frac{1}{2} + \frac{1}{2}G_{min}^2\right) - G_{min} + 1.$$

Preferably, a method for speech enhancement comprises a method according to the invention.

Furthermore, there is provided a computer program product with a computer program which comprises software means for executing the method, if the computer program is executed in a control unit.

Finally, there is provided a hearing aid with a digital signal processor for carrying out the method.

If a bias correction according to the invention is applied, the speech power estimation based on CTS yields consistent improvements in terms of segmental SNR, noise reduction, and speech distortion. This can be attributed to the fact that in the cepstral domain speech specific properties can be taken into account.

The above described methods are preferably employed for the speech enhancement of hearing aids. However, the present application is not limited to such use only. The described methods can rather be utilized in connection with other audio devices.

BRIEF DESCRIPTION OF THE DRAWINGS

More specialties and benefits of the present invention are explained in more detail by means of schematic drawings showing in.

DETAILED DESCRIPTION OF INVENTION

Figure 1:
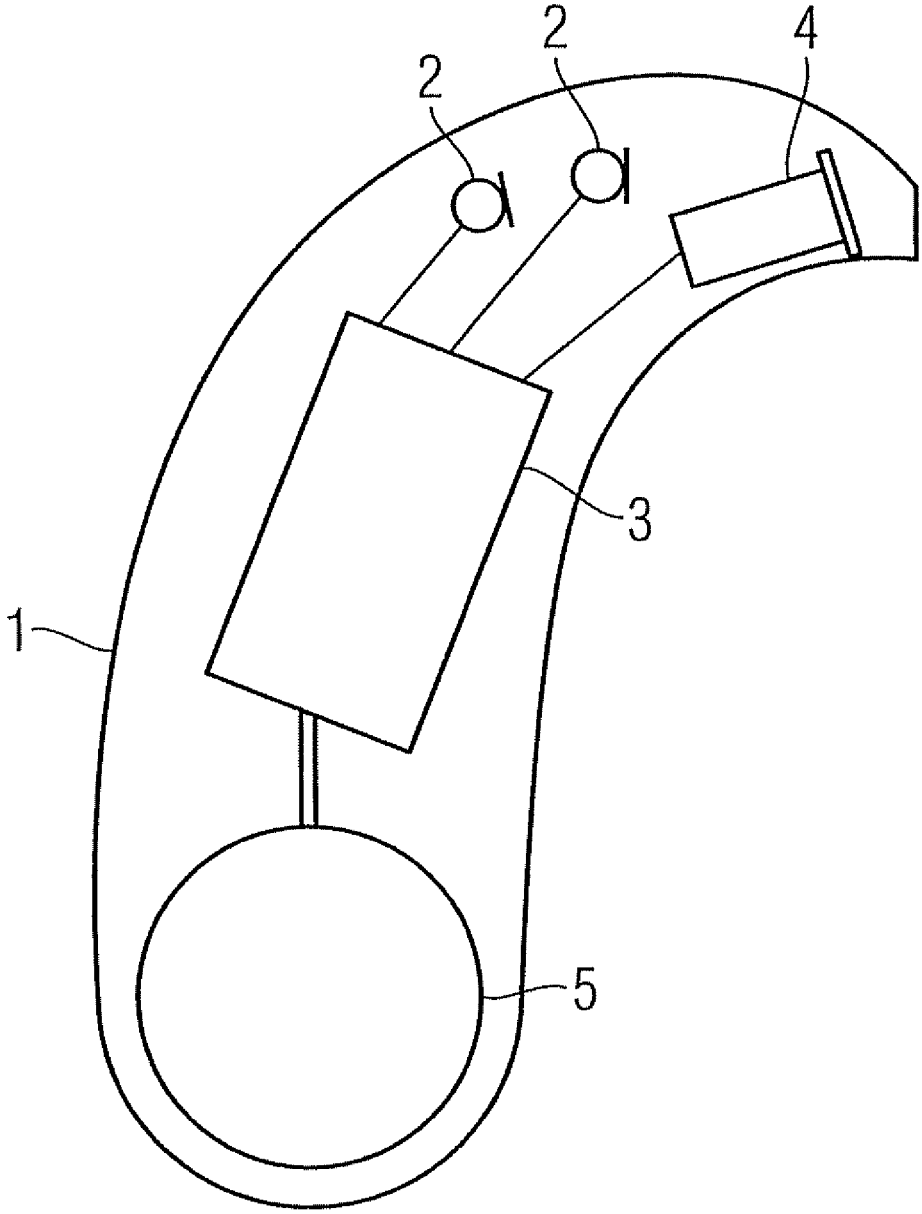
FIG. 1: the principle structure of a hearing aid.

Since the present application is preferably applicable to hearing aids, such devices shall be briefly introduced in the next two paragraphs together with FIG. 1.

Hearing aids are wearable hearing devices used for supplying hearing impaired persons. In order to comply with the numerous individual needs, different types of hearing aids, like behind-the-ear hearing aids and in-the-ear hearing aids, e.g. concha hearing aids or hearing aids completely in the canal, are provided. The hearing aids listed above as examples are worn at or behind the external ear or within the auditory canal. Furthermore, the market also provides bone conduction hearing aids, implantable or vibrotactile hearing aids. In these cases the affected hearing is stimulated either mechanically or electrically.

In principle, hearing aids have an input transducer, an amplifier and an output transducer as essential component. The input transducer usually is an acoustic receiver, e.g. a microphone, and/or an electromagnetic receiver, e.g. an induction coil. The output transducer normally is an electroacoustic transducer like a miniature speaker or an electromechanical transducer like a bone conduction transducer. The amplifier usually is integrated into a signal processing unit. Such principle structure is shown in FIG. 1 for the example of a behind-the-ear hearing aid. One or more microphones 2 for receiving sound from the surroundings are installed in a hearing aid housing 1 for wearing behind the ear. A signal processing unit 3 being also installed in the hearing aid housing 1 processes and amplifies the signals from the microphone. The output signal of the signal processing unit 3 is transmitted to a receiver 4 for outputting an acoustical signal. Optionally, the sound will be transmitted to the ear drum of the hearing aid user via a sound tube fixed with an otoplasty in the auditory canal. The hearing aid and specifically the signal processing unit 3 are supplied with electrical power by a battery 5 also installed in the hearing aid housing 1.

For speech enhancement in the short-time DFT-domain, a noisy time domain speech signal is segmented into short frames, e.g. of length 32 ms. Each signal segment is windowed, e.g. with a Hann window, and transformed into the Fourier domain. The resulting complex spectral representation $Y_k(1)$ is a function of the spectral frequency index $k\in[0,K]$ and the segment index 1. The spectral coefficients of the noise signal $N_k(1)$ are assumed additive to the speech spectral coefficients $S_k(1)$, i.e. $Y_k(1)=S_k(1)+N_k(1)$. Note that the noise signal, $N_k(1)$, may be environmental noise as well as competing talkers as in the case of speaker separation. The aim of speech enhancement algorithms is to estimate the clean speech signal $S_k(1)$ given the noisy observation $Y_k(1)$. This is often achieved via a multiplicative gain function $G_k(1)$. An estimate $\hat{S}_k(l)$ of the clean speech spectral coefficients is thus computed as $$\hat{S}_k(l)=G_k(l)Y_k(l). \tag{1}$$

Cepstro-temporal smoothing (CTS) is based on the idea that in the cepstral domain, speech is represented by few coefficients, which can be robustly estimated. A cepstral transform $\Phi_q(1)$ of some positive, real valued spectral parameter $\Phi_k(l)$ of the speech enhancement algorithm (like the estimated speech periodogram or the gain function) is given by $$\Phi_q(l)=\mathrm{IDFT}\{\log \Phi_k(l)\}, \tag{2}$$

where $q\in[0,K]$ is the cepstral quefrency index, and IDFT $\{\bullet\}$ the inverse DFT. Note that as $\Phi_k(l)$ is real-valued $\Phi_q(1)$ is symmetric with respect to $q=K/2$. Therefore, in the following only the part $q\in[0,K/2]$ is discussed.

The lower cepstral coefficients $q\in[0,q_{low}]$ with, preferably, $q_{low}\in K/2$ represent the spectral envelope of $\Phi_k(l)$. For speech signals, the spectral envelope is determined by the transfer function of the vocal tract. The higher cepstral coefficients $q_{low}<q<K/2$ represent the fine-structure of $\Phi_k(l)$. For speech signals, the fine-structure is caused by the excitation of the vocal tract. For voiced speech, the excitation is mainly represented by a dominant peak at $q_0=f_s/f_0$, with $f_0$ the fundamental frequency. This fundamental frequency $f_0$ can be found by a maximum search in $q\in[q_{low},K/2]$. Thus, in the cepstral domain voiced speech can be represented by the set $$\mathbb{Q}=\{[0,q_{low}],q_0\}. \tag{3}$$

If $\Phi_k(l)$ is an estimated parameter, like the estimated speech periodogram, or the spectral gain function, its fine-structure is also influenced by spectral outliers caused by estimation errors. Therefore, a recursive temporal smoothing is now applied on $\Phi_q(l)$ such that only little smoothing is applied to those cepstral coefficients, $q\in Q$ that are dominated by speech and strong smoothing to all other coefficients:

$$\overline{\Phi}_q(l)=\alpha_q\overline{\Phi}_q(l-1)+(1-\alpha_q)\Phi_q(l), \tag{4}$$

with smoothing parameters $\alpha_q$ $$\alpha_q=\begin{cases}\ll 1, & \text{for } q\in\mathbb{Q}\\ \to 1, & \text{else.}\end{cases} \tag{5}$$

After the recursive smoothing $\overline{\Phi}_q(l)$ is transformed to the spectral domain to achieve the cepstro-temporally smoothed spectral parameter $\overline{\Phi}_k(l)$, as $$\overline{\Phi}_k(l)=\exp(\mathrm{DFT}\{\overline{\Phi}_q(l)\}). \tag{6}$$

CTS allows for a reduction of spectral outliers due to estimation errors, while the speech characteristics are preserved. In the following cepstro-temporally smoothed parameters are marked by a bar, e.g. $\overline{G}$ for the cepstro-temporally smoothed spectral filter gain.

In [1] CTS of the spectral gain function is proposed (i.e. $\Phi_k(l)=G_k(1)$ in equation (2)) to reduce spectral outliers that do not correspond to speech but to estimation errors. Smoothing the gain function for reducing spectral outliers is a very flexible technique. It can be applied to any speech enhancement algorithm where the output signal is gained via a multiplicative gain function as in equation (1). This includes noise reduction [1] and source separation.

Figure 2:
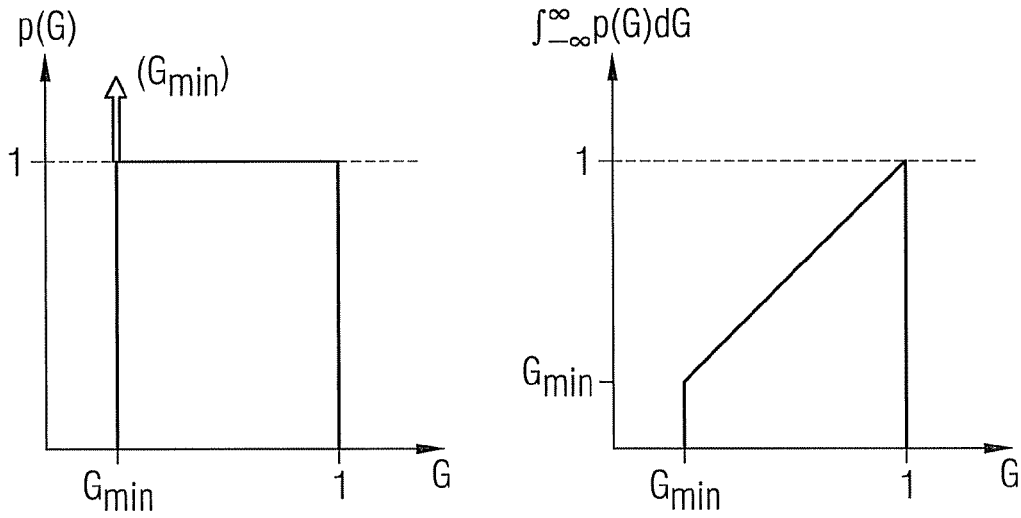
FIG. 2: the assumed PDF of the gain function and its cumulative distribution.

In speech enhancement algorithms the gain function is usually bound to be larger than a certain value $G_{min}$. Therefore, after the derivation of a gain function G', a constrained gain G is computed as $G=\max\{G',G_{min}\}$. The choice of $G_{min}$ is a trade-off between speech distortion, musical noise and noise reduction. A large $G_{min}$ masks musical noise and reduces speech distortions at the cost of less noise reduction. The aim of the invention is to derive a general bias correction for CTS of arbitrary gain functions. We thus assume a uniform distribution of G' between 0 and 1, independent of its derivation and the underlying distribution of the speech and noise spectral coefficients. To construct the Probability Density Function PDF of the constrained G we map $$\int_0^{G_{min}} p(G')\,dG'$$

onto $p(G=G_{min})$. In FIG. 2 this assumed PDF p(G) of the gain function G is shown on the left and its cumulative distribution is shown on the right hand side.

Since the values of the gain function are limited in their dynamic range ($G_{min} \leqq G \leqq 1$), the non-linear compression via the log-function in equation (2) is not mandatory, i.e. the principle behavior of the cepstral coefficients stays the same with or without the log-function. However, in [1] it is noted, that incorporating the log-function may help reducing noise shaping effects that may arise due to the temporal smoothing. We argue that the recursive smoothing in equation (4) can be interpreted as an approximation of the expected value operator E( ). However, if the log-function is applied in equation (2) the averaging corresponds to a geometric mean rather than an arithmetic mean. Therefore, CTS changes the mean of the gain function, as in general $E\{G\} \neq \exp(E\{\log(G)\})$. If the distribution of G is known the bias correction $\kappa_G$ can be determined and accounted as $$\kappa_G = \log(E\{G\}) - E\{\log(G)\}. \tag{7}$$

For the distribution given in FIG. 2 the expected value E{G} of the gain function G can be determined as:

$$E\{G\} = G_{min}^2 + \int_{G_{min}}^{1} G\,dG = \frac{1}{2}(1 + G_{min}^2), \tag{8}$$

and the expected value of the log-gain function results in $$\begin{aligned} E\{\log G\} &= G_{min}\log G_{min} + \int_{G_{min}}^{1} \log G\,dG \\ &= G_{min} - 1. \end{aligned} \tag{9}$$

With equation (7) the bias correction $\kappa_G$ thus results in:

$$\kappa_G(G_{min}) = \log\left(\frac{1}{2} + \frac{1}{2}G_{min}^2\right) - G_{min} + 1. \tag{10}$$

We can now apply a bias correction $\kappa_G$ to a cepstro-temporally smoothed gain function $\overline{G}_k(l)$ as $$\tilde{G}_k(l) = \overline{G}_k(l)\exp(\kappa_G). \tag{11}$$

Figure 3:
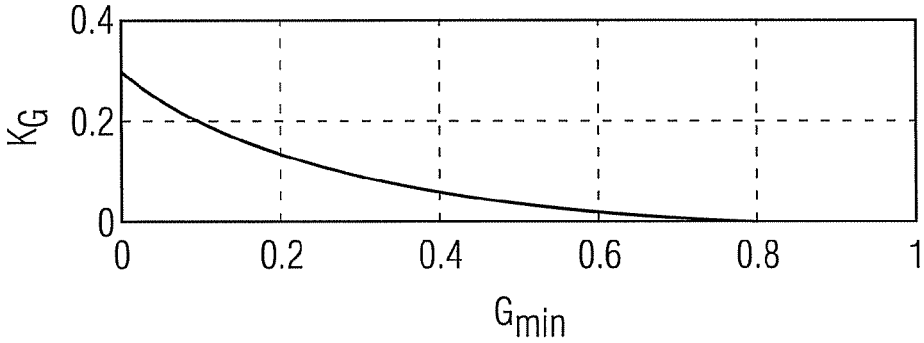
FIG. 3: the bias correction for a CTS of the filter gain, as function of the lower limit of the gain function

In FIG. 3 the bias correction $\kappa_G$ is plotted as a function of $G_{min}$. Note that, as small values of G have a strong influence on the difference between geometric and arithmetic mean, the bias correction $\kappa_G$ is larger the smaller $G_{min}$. The cepstro-temporally smoothed and bias compensated spectral gain $\tilde{G}_k(l)$ can now be applied to the noisy speech spectrum as in equation (1).

As in [1] we compare CTS now to a softgain method of. We use the same smoothing constants for the softgain method and CTS as used for the listening tests in [1]. There, the smoothing constants were chosen so that both methods do not produce musical noise in stationary noise. As in [1] we set the lower limit on the gain function to 20 log 10($G_{min}$)=−15 dB. In [1] listening tests indicated a clear preference for CTS. In the following we evaluate the algorithms in terms of instrumental measures. We measure the SNR in terms of the frequency weighted segmental SNR (FW-SNR), speech distortion in terms of the Itakura-Saito distance, and noise reduction. We process 320 speech samples that sum up to approximately 15 minutes of fluent, phonetically balanced conversational speech of both male and female speakers. The speech samples are disturbed by several noise types.

Figure 4:
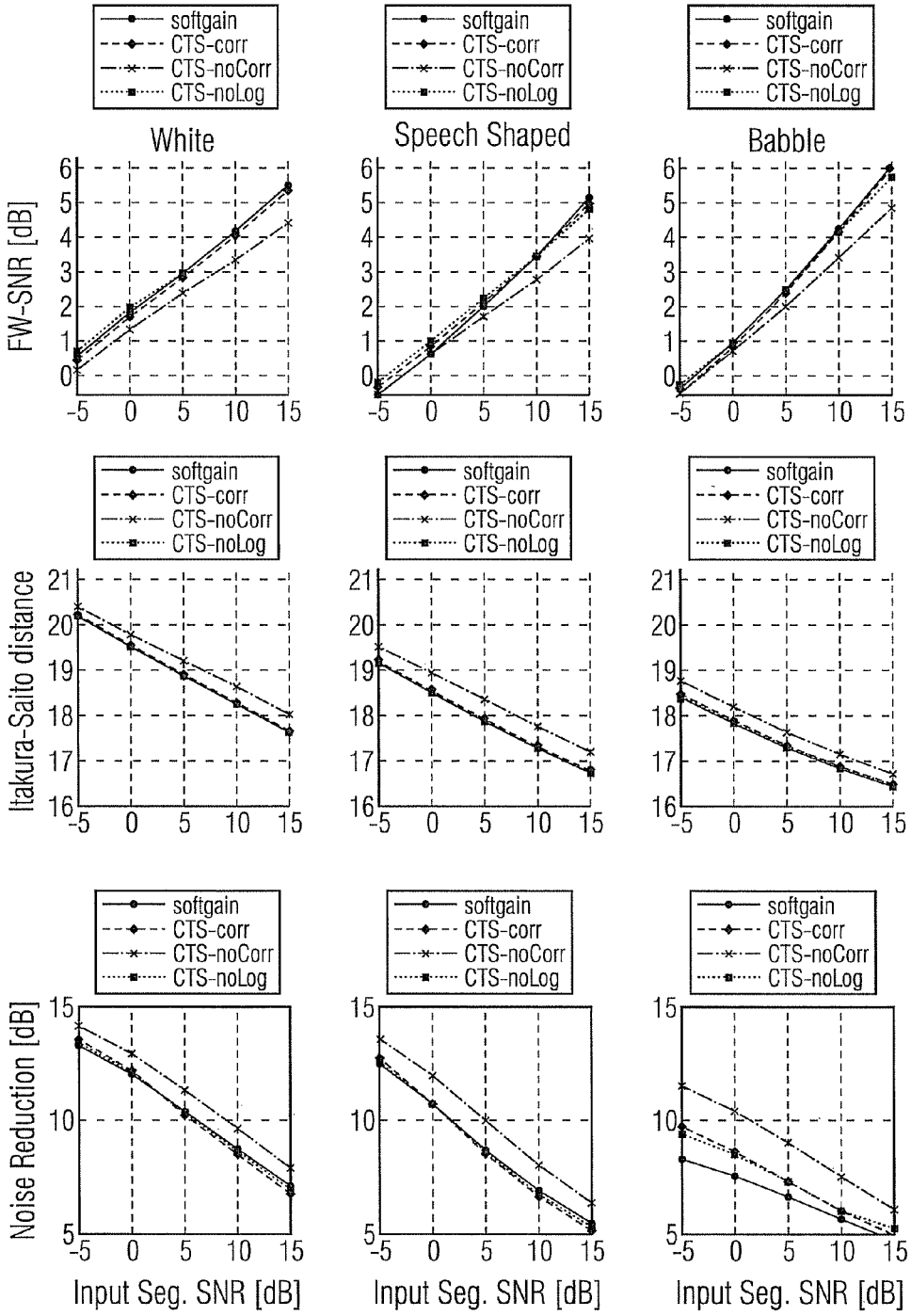
FIG. 4: averages of segmental frequency weighted SNR, Itakura-Saito distance and noise reduction for 320 TIMIT sentences and white stationary Gaussian noise, speech shaped noise and babble noise.

The results are presented in FIG. 4 for input segmental SNRs between −5 and 15 dB. For CTS we present results without a bias-correction (CTSnoCorr), with the bias correction (CTS-corr), and when the cepstrum is computed without the log function in equation (2) (CTS-noLog). As for CTS-noLog the temporal smoothing is done in the linear domain, a bias-correction is not necessary. The results are given in FIG. 4. The FW-SNR and the Itakura-Saito distance indicate a decreased performance when comparing CTS-noCorr to the softgain method. This decrease of performance can be attributed to the bias that occurs due to the temporal smoothing in the log-domain.

We see that the decrease in performance is compensated with the proposed bias correction of equation (10), as CTS-noLog, CTS-corr, and the softgain method yield similar results in terms of FW-SNR, Itakura-Saito measure, and, for stationary noise, noise reduction. Further it can be seen that CTS is very effective in non-stationary noise. For babble noise CTS-corr and CTS-noLog achieve a higher noise reduction than the softgain method while the SNR and the speech distortion are virtually the same. This can be attributed to a successful elimination of spectral outliers caused by babble noise. Thus, even in babble noise, CTS yields an output signal without musical noise. In [1] the successful elimination of spectral outliers has been shown via statistical analyses, and listening tests indicated a residual noise of higher perceived quality.

The invention claimed is:

1. A method for operating a hearing aid, the hearing aid comprising a digital signal processor having a gain function, the method comprising:

receiving an input signal by the digital signal processor, modifying a cepstro-temporally smoothed gain function of the gain function resulting in a bias compensated spectral gain function based on the received input signal, the step of modification comprising:

calculating an exponent of a bias correction value;

multiplying the cepstro-temporally smoothed gain function with the exponent of the bias correction value using the equation $$\tilde{G}_k(l) = \overline{G}_k(l)\exp(\kappa_G),$$

wherein the bias correction value is dependent on a smallest value of the gain function using the equation $$\kappa_G(G_{min}) = \log\left(\frac{1}{2} + \frac{1}{2}G_{min}^2\right) - G_{min} + 1.$$

2. The method as claimed in claim 1, wherein the gain function has a probability density function p(G), which is constructed by mapping $$\int_0^{G_{min}} p(G')\,dG' \text{ onto } p(G = G_{min}).$$

3. The method as claimed in claim 1, further comprising:

estimating clean speech spectral coefficients of a noisy signal using the equation $$\hat{S}_k(l)=\tilde{G}_k(l)\times Y_k(l),$$

wherein $\hat{S}_k$ (l) is an estimate of the clean speech spectral coefficients, $\tilde{G}_k(l)$ is the bias compensated gain function and $Y_k(l)$ is a noisy observation of a signal.

4. The method as claimed in claim 2, further comprising:

estimating clean speech spectral coefficients of a noisy signal using the equation $$\hat{S}_k(l)=\tilde{G}_k(l)\times Y_k(l),$$

wherein $\hat{S}_k(l)$ is an estimate of the clean speech spectral coefficients, $\tilde{G}_k(l)$ is the bias compensated gain function and $Y_k(l)$ is a noisy observation of a signal.

5. The method as claimed in claim 1, wherein the method is used for speech enhancement.

6. The method as claimed in claim 2, wherein the method is used for speech enhancement.

7. The method as claimed in claim 3, wherein the method is used for speech enhancement.

8. A non-transitory computer readable medium storing a computer program which executes a method for modification of a cepstro-temporally smoothed gain function of a gain function resulting in a bias compensated spectral gain function when the computer program is executed in a control unit, the method comprising:

calculating an exponent of a bias correction value;

multiplying the cepstro-temporally smoothed gain function with the exponent of the bias correction value using the equation $$\tilde{G}_k(l)=\overline{G}_k(l)\exp(\kappa_G),$$

wherein the bias correction value is dependent on a smallest value of the gain function using the equation $$\kappa_G(G_{min}) = \log\left(\frac{1}{2} + \frac{1}{2}G_{min}^2\right) - G_{min} + 1.$$

9. The non-transitory computer readable medium as claimed in claim 8, wherein the gain function has a probability density function p(G), which is constructed by mapping $$\int_0^{G_{min}} p(G')\,dG' \text{ onto } p(G = G_{min}).$$

10. The non-transitory computer readable medium as claimed in claim 8, the method further comprising:

estimating clean speech spectral coefficients of a noisy signal using the equation $$\hat{S}_k(l)=\tilde{G}_k(l)\times Y_k(l),$$

wherein $\hat{S}_k(l)$ is an estimate of the clean speech spectral coefficients, $\tilde{G}_k(l)$ is the bias compensated gain function and $Y_k(l)$ is a noisy observation of a signal.

11. The non-transitory computer readable medium as claimed in claim 8, wherein the method is used for speech enhancement.

12. A hearing aid, comprising:

a digital signal processor configured to execute a method for modification of a cepstro-temporally smoothed gain function of a gain function resulting in a bias compensated spectral gain function, the method executed by the digital signal processor comprising:

calculating an exponent of a bias correction value;

multiplying the cepstro-temporally smoothed gain function with the exponent of the bias correction value using the equation $$\tilde{G}_k(l)=\overline{G}_k(l)\exp(\kappa_G),$$

wherein the bias correction value is dependent on a smallest value of the gain function using the equation $$\kappa_G(G_{min}) = \log\left(\frac{1}{2} + \frac{1}{2}G_{min}^2\right) - G_{min} + 1.$$

13. The hearing aid as claimed in claim 12, wherein the gain function has a probability density function p(G), which is constructed by mapping $$\int_0^{G_{min}} p(G')\,dG' \text{ onto } p(G = G_{min}).$$

14. The hearing aid as claimed in claim 12, the method executed by the digital signal processor further comprising:

estimating clean speech spectral coefficients of a noisy signal using the equation $$\hat{S}_k(l)=\tilde{G}_k(l)\times Y_k(l),$$

wherein $\hat{S}(l)$ is an estimate of the clean speech spectral coefficients, $\tilde{G}_k(l)$ is the bias compensated gain function and $Y_k(l)$ is a noisy observation of a signal.

15. The hearing aid as claimed in claim 13, wherein the method executed by the digital signal processor is used for speech enhancement.

* * * * *